US009890999B2

(12) United States Patent
Sarres et al.

(10) Patent No.: US 9,890,999 B2
(45) Date of Patent: Feb. 13, 2018

(54) INDUSTRIAL HEAT TREATING FURNACE THAT USES A PROTECTIVE GAS

(71) Applicant: IPSEN, INC., Cherry Valley, IL (US)

(72) Inventors: Rolf Sarres, Oberhausen (DE); Marc Angenendt, Rees (DE)

(73) Assignee: Ipsen, Inc., Cherry Valley, IL (US)

( * ) Notice: Subject to any disclaimer, the term of this patent is extended or adjusted under 35 U.S.C. 154(b) by 503 days.

(21) Appl. No.: 14/048,793

(22) Filed: Oct. 8, 2013

(65) Prior Publication Data

US 2014/0106287 A1 Apr. 17, 2014

(30) Foreign Application Priority Data

Oct. 8, 2012 (DE) ..... 10 2012 019 653

(51) Int. Cl.

| | |
|---|---|
| ***F27D 3/00*** | (2006.01) |
| ***F27B 9/04*** | (2006.01) |
| ***F27B 9/16*** | (2006.01) |
| ***F27B 9/22*** | (2006.01) |
| ***F27B 17/00*** | (2006.01) |
| ***F27D 7/06*** | (2006.01) |
| ***F27D 15/02*** | (2006.01) |
| ***F27B 13/06*** | (2006.01) |
| ***F27D 99/00*** | (2010.01) |
| *F27D 9/00* | (2006.01) |

(52) U.S. Cl.

CPC ..... *F27D 3/00* (2013.01); *F27B 9/045* (2013.01); *F27B 9/047* (2013.01); *F27B 9/16* (2013.01); *F27B 9/22* (2013.01); *F27B 13/06* (2013.01); *F27B 17/0033* (2013.01); *F27D 7/06* (2013.01); *F27D 15/0286* (2013.01); *F27D 99/0073* (2013.01); *F27D 2009/0089* (2013.01)

(58) Field of Classification Search

USPC ..... 432/56, 200, 9, 10, 121, 128

See application file for complete search history.

(56) References Cited

U.S. PATENT DOCUMENTS 1,825,380 A * 9/1931 Alinder ..... C21D 9/00 266/253
3,459,417 A * 8/1969 Budzynski ..... C21O 5/32 266/214

(Continued)

FOREIGN PATENT DOCUMENTS

| | | |
|---|---|---|
| DE | 3506131 | 5/1986 |
| DE | 19947482 | 11/2002 |
| DE | 10258728 | 3/2004 |

*Primary Examiner* — Alissa Tompkins
*Assistant Examiner* — John Bargero
(74) *Attorney, Agent, or Firm* — Dann, Dortman, Herrell and Skillman, P.C.

(57) ABSTRACT

An industrial furnace (1) into which protective gas is admitted for the heat treatment of batches (5) of metal workpieces is described. The heat treating furnace includes an entrance lock (2) which can be sealed with respect to the surrounding environment by means of a first gas-tight closure device (2.2.1). The heat treating furnace also includes a third gas-tight closure device (3.1) disposed between a heat treatment chamber (3) of the furnace and a quenching facility (4) at the exit of the heat treatment chamber. With the foregoing arrangement a pressure of the protective gas admitted into the heat treatment chamber (3) can be maintained during loading and unloading of a batch of metal workpieces (5). The entrance lock may be configured as a dual-chamber vertical arrangement or as a single chamber horizontal arrangement.

13 Claims, 6 Drawing Sheets

(56) References Cited

U.S. PATENT DOCUMENTS

| | | | | | |
|---|---|---|---|---|---|
| 3,625,496 | A * | 12/1971 | Bornor | C21D 9/0006 | 220/378 |
| 3,926,415 | A * | 12/1975 | Konas | C21D 1/74 | 219/654 |
| 4,032,290 | A * | 6/1977 | Soderlund | F27B 5/10 | 432/200 |
| 5,402,994 | A * | 4/1995 | Egger | C21D 1/74 | 266/252 |
| 5,882,484 | A * | 3/1999 | Pyy | C10B 35/00 | 201/14 |
| 2009/0314388 | A1* | 12/2009 | Edenhofer | C21D 1/763 | 148/216 |
| 2011/0042866 | A1* | 2/2011 | Grobler | C21D 1/74 | 266/44 |

* cited by examiner

INDUSTRIAL HEAT TREATING FURNACE THAT USES A PROTECTIVE GAS

BACKGROUND OF THE INVENTION

Field of the Invention

The invention, which is also referred to as a "closed up system", relates to a gas-tight industrial heat treating furnace into which protective gas is admitted. More particularly, the heat treating furnace is embodied as a chamber furnace, a pusher-type furnace, a rotary hearth furnace, or a ring hearth furnace for the heat treatment of batches of metal workpieces.

Description of the Related Art

Industrial furnaces that can largely be assigned to the above generic type are known. The demand for a particularly high throughput rate of such industrial furnaces is linked to very flexible production, for which reason continuously operating furnace plants have also become established, aside from automated chamber furnace plants. Single- or multi-line pusher-type furnace plants, rotary hearth furnaces and ring hearth furnaces are primarily used in continuous furnace plants.

Thus, it is known according to DE 199 47 482 B2 to undertake an optimization of the use of rotary hearth furnaces by a special arrangement or splitting-up of pallets in a rotary hearth furnace.

According to DE 102 58 728 A1, a ring hearth furnace is proposed with a hollow hub, which is suitable for the treatment of shells with bulk material.

Moreover, DE 35 06 131C1 discloses a method and a device with a time-independent batch removal from a rotary hearth furnace as well as a heating operation in a separate preheating zone.

In this regard, it was found that a time-independent removal of batches and a heating operation in a separate preheating zone is costly at least in terms of energy.

According to the generally known prior art, generic plants of industrial furnaces are in principle suitable for the standard heat treatment processes, such as carburizing, nitriding, hardening, annealing and tempering.

For performing simultaneously one or more case hardening steps with the workpieces, single- or multi-line pusher-type furnaces have become established, which are characterized by a compact and therefore space-saving design.

Continuous furnaces that operate according to the pusher principle are suitable for the heat treatment of charged parts with and without protective gas atmospheres. The high-temperature heat treatment furnace and the quenching facility usually form a unit. The latter is linked together with low-temperature furnaces for preheating and for tempering, with cleaning systems and charge transport systems, to form complex plants. The latter thus also enable the treatment of large batch weights without problem.

The equipping of a high-temperature heat treatment furnace with a powerful recirculation fan provides both a homogeneous distribution of the protective gas in the individual zones of the heat treatment chamber (e.g. heating zone, carburizing zone, diffusion zone etc.), as well as a generous flow circulation of the highly reactive gases around the workpiece. This system and the optimized thermodynamics as well as burner systems ensure an optimum uniformity and reproducibility of the heat treatment results.

Intermediate doors between the individual heat treatment zones further enable the achievement of required temperature differences and different carbon levels in the individual regions.

Apart from pusher-type furnaces, rotary hearth furnaces and ring hearth furnaces have also become established for use in continuous heat treatment plants, in order to treat large series of parts of identical design and thus to achieve high throughput rates.

By means of a process-related arrangement of different heat treatment zones beside one another in the form of various ring hearth furnaces, it is possible, here too, to achieve simultaneously different case hardening depths in the same plant. Different dwell times during the carburizing phase can be controlled individually with a corresponding configuration of the process control.

Rotary hearth furnaces are furnaces with a disc-shaped hearth and a large treatment space without zone separation. Ring hearth furnaces are furnaces which have an annular hearth and heat treatment space, wherein the zones are separated from one another by intermediate doors.

Rotary hearth furnaces which have a disc-shaped hearth are usually advisable only up to a limited size, because otherwise the furnace space and therefore the gas consumption of the furnace becomes too large. The furnaces of this type are loaded and unloaded manually or automatically and can be linked to other plant components. The rotary hearth furnace type is mainly suitable for individual batch loading and removal and is therefore used mainly for the carburizing or reheating of workpieces before a press-hardening process.

Ring hearth furnaces are suitable both for individual loading as well as for loading in the form of batches. Whereas individual loading is primarily used in connection with subsequent press hardening, loading with batches chiefly takes place with subsequent quenching in oil, salt or gas. The fundamental advantage of ring hearth furnaces consists of a central hearth drive, as a result of which a plurality of drive motors is not required, in contrast with a pusher-type furnace. The careful transport of the workpieces is also advantageous, since no relative displacement of the batch with respect to the hearth is required. This arrangement results in an extremely small mechanical loading of the batch carriers and the hearth floor, and use can be made of lighter batch carriers.

It proves to be a drawback with these generically described types of industrial furnaces, however, that the frequent door opening during the loading and unloading of batches of workpieces into the high-temperature heat treatment chambers disturbs the furnace atmosphere because the internal or excess pressure in the furnace collapses and a fall in the carbon level in the furnace atmosphere also occurs.

As a result, the treatment of the workpieces is adversely affected in terms of quality because an increased edge oxidation of the workpieces can be caused. Moreover, a large quantity of protective gas has to be repeatedly conveyed into the furnace after the closing of the doors in order to restore the desired furnace pressure and the required carbon level. Apart from the heat treatment process being disturbed, the energy loss is therefore also a disadvantage.

SUMMARY OF THE INVENTION

In accordance with a first aspect of the present invention there is provided an industrial furnace (1) into which protective gas is admitted for the heat treatment of batches (5) of metal workpieces. The industrial heat treating furnace includes an entrance lock (2), which can be sealed with respect to the surrounding environment by means of a first gas-tight closure device (2.2.1). The furnace also includes a third gas-tight closure device (3.1) disposed between a heat treatment chamber (3) and a subsequent quenching facility (4). A pressure of the protective gas admitted into the heat treatment chamber (3) can be maintained during loading and unloading of a batch of metal workpieces (5).

In accordance with a second aspect of the present invention the entrance lock (2) according to the first aspect of the invention is configured in a vertical arrangement and comprises a first lock chamber (2.2) and a second lock chamber (2.3) position above the first lock chamber. The first and second lock chambers are separated from one another in a sealable manner by an integrated second gas-tight closure device (2.2.2) which includes a lift elevator (2.4). In this manner the first lock chamber (2.2) is sealable from the surrounding environment by the first gas-tight closure device (2.2.1). The industrial furnace further includes a gas-permeable door (2.3.1) for sealing the second lock chamber (2.3) from the heat treatment chamber (3).

In accordance with a third aspect of the present invention there is provided an industrial furnace (1) into which protective gas is admitted for the heat treatment of batches (5) of metal workpieces. The industrial heat treating furnace includes an entrance lock (2), which can be sealed with respect to the surrounding environment by means of a first gas-tight closure device (2.2.1). The furnace also includes a third gas-tight closure device (3.1) disposed between a heat treatment chamber (3) and a subsequent quenching facility (4). A pressure of the protective gas admitted into the heat treatment chamber (3) can be maintained during loading and unloading of a batch of metal workpieces (5). In the industrial furnace according to this third aspect, the entrance lock (2) is configured in a horizontal arrangement that includes only a first lock chamber (2.3). The first gas-tight closure device (2.2.1) is disposed at an entrance side of the first lock chamber and the first lock chamber is separated from the heat treatment chamber (3) in a sealable manner by a second gas-tight closure device (2.2.2).

Here and throughout this Specification and the appended Claims the following terms are used: "lock", "protective gas", and "press hardening". The term "lock" is defined to mean an air lock or similar device that permits the passage of an object between a pressure vessel and its surroundings while minimizing the change of pressure in the vessel and loss of atmosphere from it. The lock typically consists of a small chamber with two gastight doors arranged in series and which do not open simultaneously.

The term "protective gas" is defined to mean a type of gas used in heat treatment processes such as carburizing, nitriding, annealing, and tempering that are performed in a gaseous atmosphere to prevent oxidation and other adverse effects on the metal parts being heat treated.

The term "press hardening" is defined to mean a process in which heated metal parts, such as gears, bearing races etc., are subjected to controlled hardening in restraining dies to ensure dimensional control and uniform hardening.

DETAILED DESCRIPTION

The invention is directed to resolution of the problem of creating a gas-tight industrial furnace of any type described above into which protective gas is admitted. The industrial furnace according to the present invention includes gas-tight sealable chambers at the entrance to the heat treatment chamber and at the exit from the heat treatment chamber to a quenching facility (such as an oil bath, salt bath or high-pressure gas quenching facility). The arrangement provides a disruption-free, high-quality heat treatment process and enables a heat treatment of batches of metal workpieces that is improved in terms of energy.

Figure 1:
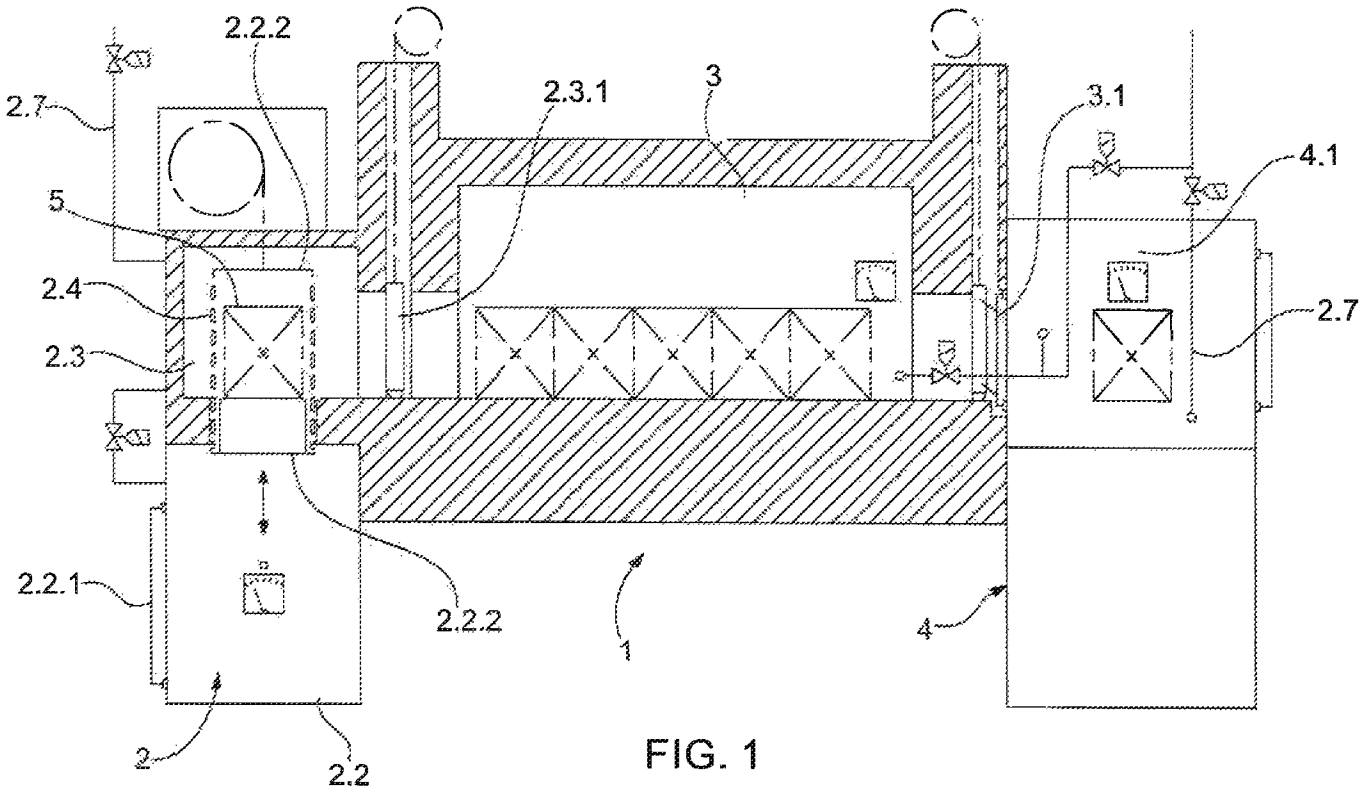
FIG. 1 is a schematic diagram that shows an arrangement of an industrial furnace according to the present invention with a vertical arrangement of an entrance air lock.

An industrial heat treating furnace according to the invention can advantageously be carried out on the basis of the inventive features by means of various plant configurations. Thus, in general, an industrial furnace for the heat treatment of batches of metal workpieces, wherein protective gas being admitted into said industrial furnace includes an entrance lock positioned as shown in FIG. 1. The entrance lock can be sealed with respect to the surroundings by means of a first gas-tight closure device. A third gas-tight closure device is positioned between a heat treatment chamber of the industrial furnace and a subsequent quenching facility. The operation of the industrial heat treating furnace according to this invention allows an applied pressure of the protective gas in the heat treatment chamber to be maintained during the loading and unloading of a batch of metal workpieces that are to be heat treated. As also can be seen in FIG. 1, the quenching facility (4) includes an exit lock (4.1) that is connected to the heat treatment chamber in a sealable manner by the third gas-tight closure device (3.1).

Figure 2:
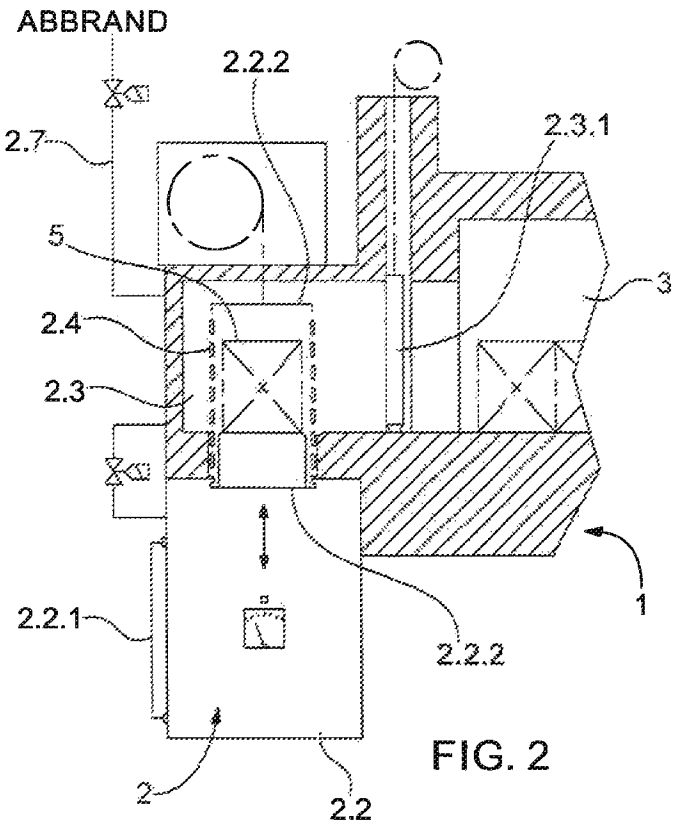
FIG. 2 is a schematic diagram that shows additional details of the entrance air lock used in the industrial furnace according to FIG. 1.
Figure 5B:
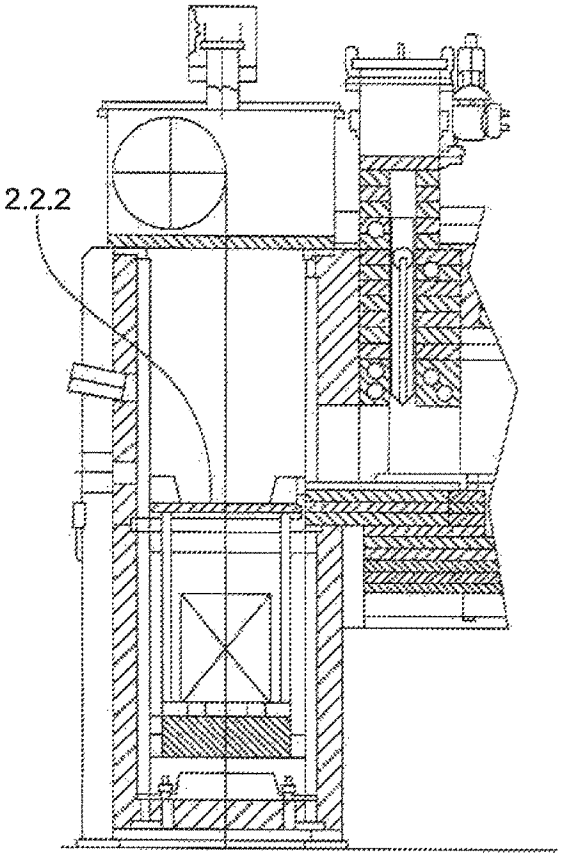
FIG. 5B is a partial schematic diagram showing details of the vertical arrangement of the entrance lock with the lift elevator in a lowered position.
Figure 5A:
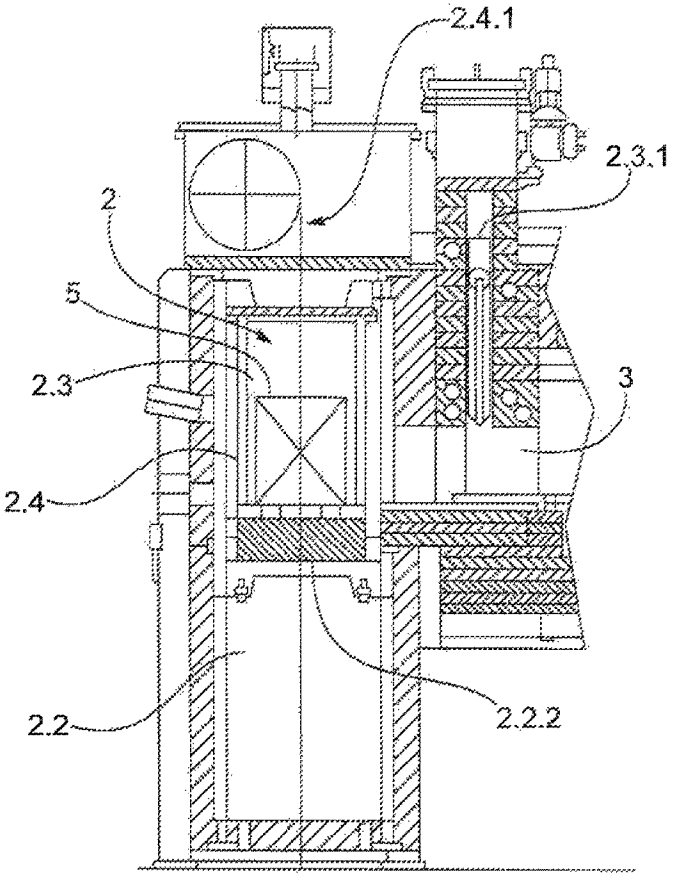
FIG. 5A is a partial schematic diagram showing details of the vertical arrangement of the entrance lock shown in FIGS. 1 and 2 with a lift elevator in a raised position.

In the case of the vertical arrangement shown in FIG. 2, the entrance lock includes first and second lock chambers positioned one above the other. The first and second lock chambers are separated from one another in a sealable manner by an integrated second gas-tight closure device which can include a lift elevator (2.4) and an associated hoist mechanism (2.4.1) for raising and lowering the lift elevator as shown in FIGS. 5A and 5B. The first lock chamber is sealable with respect to the surrounding environment by the first gas-tight closure device. The second lock chamber is sealable with respect to the heat treatment chamber by a gas-permeable door.

Figure 3:
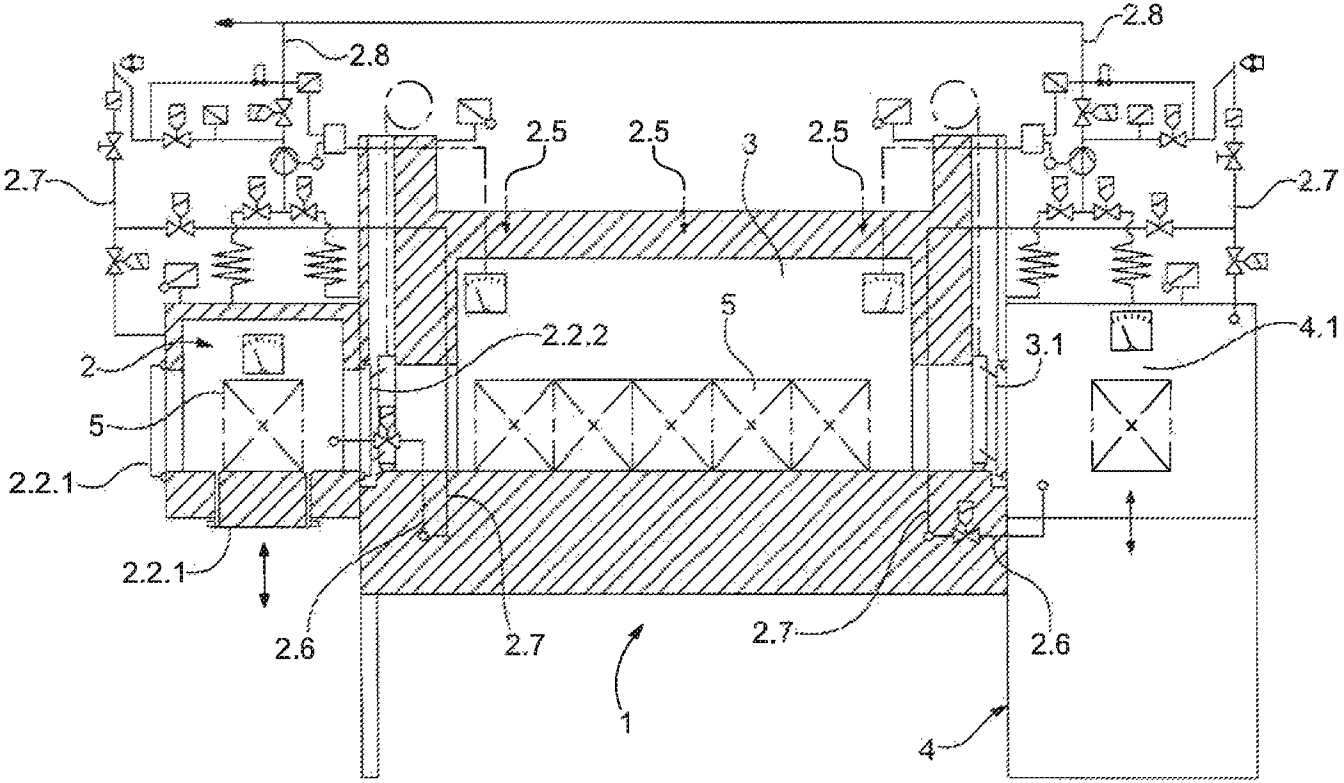
FIG. 3 is a schematic diagram that shows an arrangement of a second embodiment of an industrial furnace according to the present invention.
Figure 4:
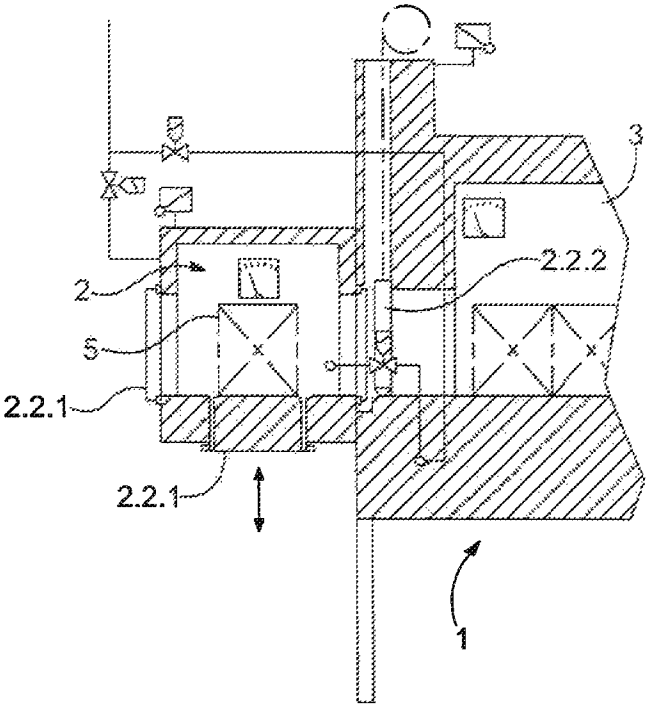
FIG. 4 is a schematic diagram of an entrance air lock in a horizontal arrangement for the industrial furnace according to FIG. 3.

In the case of a horizontal arrangement as shown in FIG. 3 and FIG. 4, the entrance lock has the first gas-tight closure device (2.2.1) and is separated from the heat treatment chamber (3) by the second gas-tight closure device (2.2.2).

Gas supply connections, protective gas supply lines, and used gas conveying lines for safeguarding the loading and unloading of the work-piece batches are preferably provided in the industrial furnace of this invention as shown in FIG. 3.

Furthermore, the entrance lock and the exit lock associated with the quenching facility include a protective gas extraction system that permits downstream use of the protective gas. In addition, the downstream use of the protective gas can be advantageously controlled through the use of a programmable furnace controller with a process step of protective gas extraction integrated into the heat treatment program. The protective gas present and required in the industrial furnace is permanently available in an energy-efficient manner.

Figure 6:
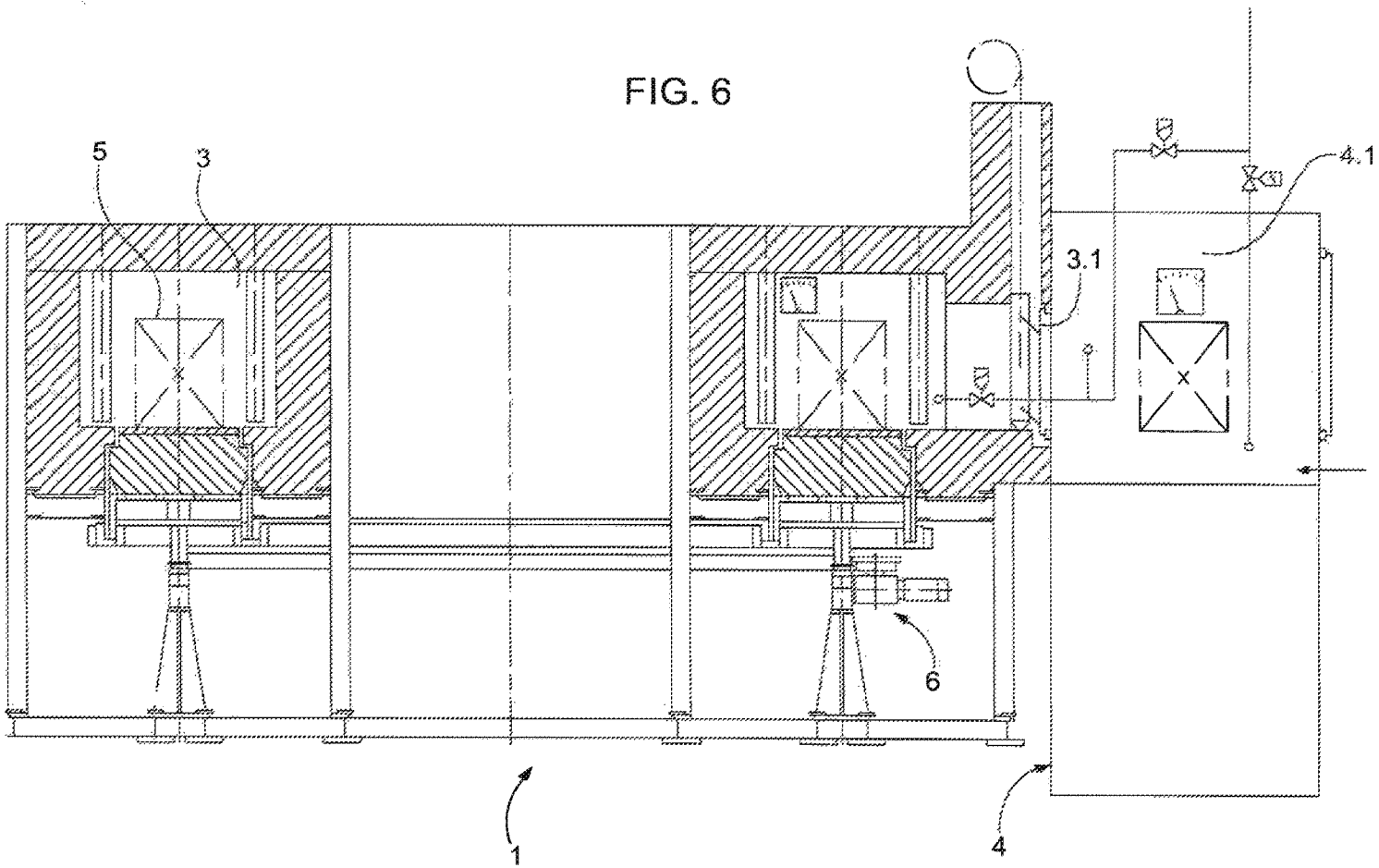
FIG. 6 is a partial schematic diagram that shows an embodiment of an industrial furnace according to the present invention that has a ring hearth.

Further, in the case of an industrial furnace that includes a ring hearth, only a single drive apparatus 6 for moving the ring hearth is used as shown in FIG. 6.

With this group of features, the invention gives rise to a particular potential for improvement, on the one hand in the quality of the heat treatment on the workpieces and on the other hand in the energy-efficient use of the protective gas.

As a result of the gas-tight separation both of the entrance lock and also of the exit lock and quenching facility from the heat treatment chamber of the furnace, it becomes possible advantageously to carry out both the loading and the unloading of the furnace without reducing the protective gas pressure or the carbon level in the heat treatment chamber. The heat treatment process thus becomes essentially continuous and the requirement of the furnace for fresh gas after the charging is reduced to a considerable extent, since only the locks at the entrance and exit ends of the furnace have to be resupplied with the protective gas after being open to the surrounding atmosphere.

For single- or multi-line arrangements, the furnace arrangement according to the present invention also gives rise to a maximum of efficiency because an optimized heat treatment result can be achieved with a reduced input of protective gas at the same time. The cost for a workpiece to be hardened, for example, can thus be considerably reduced. Pusher-type plants configured according to the present invention thus guarantee an improved, economical production operation.

Moreover, a heat treating furnace equipped according to the invention offers the possibility of reusing protective gas of the high-temperature heat treatment furnace continuously as combustion gas in other parts of the plant or in the furnace itself. This is particularly advantageous in respect of the hitherto common and frequent pressure fluctuations during the loading and unloading associated with interruptions.

Since the loading and unloading of the batches takes place by means of a lock according to the invention, the loading and unloading can, depending on the plant design, take place by means of one and the same lock, or a plurality of locks that are used for this purpose. The exit lock usually represents a part of the quenching facility which forms the unit with the high-temperature heat treatment furnace.

The known ring hearth furnaces are those which, in contrast with the locks configured according to the invention, are connected to one or more annular treatment chambers by internal doors which are not gas-tight. During the batch loading and unloading steps, the aforementioned drawbacks thus arise in the heat treatment process, such as they have already likewise been described for pusher-type furnaces.

The advantages of a heat treating furnace according to the present invention are provided therefore universally, irrespective of whether the furnace is a chamber furnace, a pusher-type furnace, a rotary hearth furnace, or a ring hearth furnace. In the industrial heat treating furnace according to the present invention, an adverse effect of the loading and unloading procedures on the heat treatment process can be avoided by the gas-tight separation of the locks from the heat treatment chamber of the furnace.

In the case of ring hearth furnaces as in the case of the pusher-type furnaces, the invention ensures a continuous use of an energy-saving system, which utilizes the employed protective gas also as a combustion gas for other parts of the plant or for the furnace.

In the case of heat treating plants in which the focus is not on the throughput rate, but primarily on flexibility, use is preferably made of atmosphere chamber furnaces as a high-temperature heat treatment furnace. The atmosphere chamber furnace is characterized by a combination of a heat treatment chamber and a quenching facility. All the steps of the heat treatment, such as for example the heating, the carburizing, the diffusion, and the reduction to the hardening temperature, usually take place sequentially in the heat treatment chamber. The atmosphere chamber furnaces can be distinguished essentially by two types concerning the passage of the batches through the furnace. According to one known type of furnace, the batches are loaded and unloaded by means of the quenching facility of the furnace. According to another type of furnace, the batches are loaded at the heat treatment chamber and unloaded at the quenching facility.

A look at atmosphere chamber furnaces shows that essentially the same heat treatment processes are carried out, as is also the case with pusher-type furnaces, rotary hearth furnaces or ring hearth furnaces. The area of application even goes in part beyond those types of furnaces, because the spectrum can be covered from the individual solution to be loaded manually to the fully automated solution and various plant components can be used in a complete plant. These can then be preheating furnaces, annealing furnaces, washing machines, batch storage units and batch transport systems.

The drawbacks associated with the existing the atmosphere chamber furnaces can be likened to those of the existing pusher-type furnaces, rotary hearth, and ring hearth furnaces, in that the furnace gas pressure and the carbon level collapse during the loading and unloading of the batches and that the furnace temperature cools down a considerable extent because of the large door openings in the furnace chamber.

Here too, the furnace according to the present invention enables loading and unloading through the quenching facility by means of a gas-tight separation between the heat treatment chamber and the quenching facility. By this means and by means of the provision of special gas supply lines and a corresponding furnace controller, the loading and unloading of the batch takes place without an adverse effect on the gas atmosphere in the heat treatment chamber.

The atmosphere chamber furnace with the loading at the heat treatment chamber is further equipped with an upstream loading lock, in a similar manner to that described above in the case of pusher-type furnaces. Here too, the continuous use of the energy-saving system becomes possible, which makes use of the protective gas as combustion gas for other parts of the plant or for the furnace itself.

Embodiments of a heat treating furnace according to the present invention are described using structural examples which can each be implemented optionally in a type of chamber furnace, pusher-type furnace, rotary hearth furnace or ring hearth furnace. FIGS. 1 to 6 show preferred embodiments of an industrial furnace 1 constructed according to the present invention. An entrance lock 2 is provided at an entrance end of a heat treating chamber 3 which can be sealed with respect to the surrounding environment by a first gas-tight closure device 2.2.1. According to FIG. 1 and FIG. 3, a third gas-tight closure device 3.1 disposed between a heat treatment chamber 3 and a following quenching facility 4 which includes an exit lock 4.1 are provided. This arrangement ensures that the pressure of a protective gas (not indicated) admitted into heat treatment chamber 3 can be maintained during loading and unloading of a batch 5.

According to a vertical arrangement of the heat treating furnace of this invention, it can be seen from FIGS. 1, 2, 5*a*, and 5*b* that an entrance lock 2 includes a first lock chamber 2.2 and a second lock chamber 2.3, which are positioned one above the other and are separated from one another in a sealable manner by an integrated second gas-tight closure device 2.2.2. The gas-tight closure device is preferably configured with a lift elevator 2.4 for moving a batch 5 of metal workpieces from the first lock chamber 2.2 into the second lock chamber 2.3. First lock chamber 2.2 can be sealed with respect to the surroundings by first gas-tight closure device or door 2.2.1, and second lock chamber 2.3 can be sealed with respect to heat treatment chamber 3 by a gas-permeable sliding door 2.3.1.

According to a horizontal arrangement of the heat treating furnace of this invention, it can be seen from FIG. 3 and FIG. 4 that an entrance lock 2 comprises first gas-tight closure device 2.2.1, such as a door, and is separated in a sealable manner with respect to heat treatment chamber 3 by a second gas-tight closure device 2.2.2.

FIG. 3 shows gas supply connections 2.5, protective gas supply lines 2.6, and used gas conveying lines 2.7, for safeguarding the loading and unloading of the batch 5, by means of which a disruption-free, high-quality heat treatment process is provided and a heat treatment of the batches of metal workpieces that is improved in terms of energy is also provided. The energy efficiency provided by the furnace arrangement according to the present invention is supplemented by the use of a protective gas extraction system 2.8 for a downstream use of the protective gas. The protective gas extraction system 2.8 is connected to entrance lock 2 and to exit lock 4.1 associated with quenching facility 4. A controller is operatively connected to protective gas extraction system 2.8 so that the downstream use of the protective gas can be efficiently controlled in a process step integrated into the heat treatment program.

Irrespective of the type of industrial furnace configuration used, therefore, the required protective gas is available permanently and in an energy-efficient manner.

In an industrial furnace 1 constituted as a ring hearth furnace, only one drive mechanism is needed for moving the ring hearth when transporting a batch 5.

A heat treating furnace plant according to the invention can be produced with conventional technological know-how. A given operator of the furnace plant according to the invention is presented with a greater practical value, which is characterized by a disruption-free, high-quality heat treatment process and a heat treatment of batches of metal workpieces that is improved in terms of energy use.

LIST OF REFERENCE NUMBERS USED IN THE DRAWING (1) industrial heat treating furnace
(2) entrance air lock
(2.1) first lock chamber
(2.2.1) first gas-tight closure device
(2.2.2) second gas-tight closure device
(2.3) second lock chamber
(2.3.1) gas-permeable door
(2.4) lift elevator
(2.4.1) lift elevator hoist
(2.5) gas supply connection
(2.6) protective gas supply line
(2.7) used gas conveying line
(2.8) protective gas extraction system
(3) heat treatment chamber
(3.1) third gas-tight closure device
(4) quenching facility
(4.1) exit lock
(5) batch

The invention claimed is:

1. An industrial furnace into which a protective gas is admitted for the heat treatment of batches of metal workpieces, comprising:

a) a heat treatment chamber that is dimensioned to hold a plurality of batches of metal workpieces, said heat treatment chamber having an entrance end and an exit end;

b) an entrance air lock connected to the entrance end of said heat treatment chamber for receiving one of the batches of metal workpieces from outside the industrial furnace, said entrance air lock having a first gas-tight door located for sealing the interior of said entrance air lock from an environment surrounding the industrial furnace, and c) a third gas-tight door disposed at the exit end of said heat treatment chamber, whereby a pressure of the protective gas admitted into the heat treatment chamber can be maintained during loading and unloading of each of the batches of metal workpieces;

said industrial furnace further comprising:

a gas supply connection disposed in a wall of the heat treatment chamber for admitting the protective gas to said heat treatment chamber and to said entrance air lock;

a used-gas conveying line connected to said entrance air lock for conveying used protective gas from said entrance air lock; and a protective gas extraction system connected to said entrance air lock for removing protective gas from the entrance air lock and transferring the protective gas, wherein said protective gas extraction system includes a programmable controller that is programmed with a heat treatment program having a process step of protective gas extraction for the downstream use of the protective gas or for reuse in the industrial furnace itself.

2. The industrial furnace according to claim 1 comprising an exit lock connected to the exit end of said heat treatment chamber in a sealable manner by the third gas-tight door.

3. The industrial furnace according to claim 1 wherein said entrance air lock comprises a vertical arrangement that includes a first lock chamber, a second lock chamber positioned above said first lock chamber, an opening between said first and second lock chambers, and a lift elevator operable for movement between the first and second lock chambers through the opening, said lift elevator comprising a gas-tight closure device for sealing the second lock chamber from the first lock chamber when said lift elevator is in a fully lowered position relative to said second lock chamber and when said lift elevator is in a fully raised position relative to said second lock chamber, the first lock chamber is sealable from the surrounding environment by the first gas-tight door, the second lock chamber is connected to the entrance end of said heat treatment chamber, and the industrial furnace further comprises a gas-permeable door positioned between the second lock chamber and the heat treatment chamber.

4. The industrial furnace according to claim 1 wherein the heat treatment chamber comprises a ring hearth and a single drive mechanism connected to the ring hearth for moving the ring hearth to transport batches of metal workpieces in the heat treatment chamber during a heat treatment cycle.

5. The industrial furnace according to claim 1 wherein said entrance air lock comprises a horizontal arrangement having a single lock chamber, the first gas-tight door is positioned at an entrance side of the lock chamber, and the industrial furnace comprises a second gas-tight door positioned between the lock chamber and said heat treatment chamber.

6. The industrial furnace according to claim 5 wherein the heat treatment chamber comprises a ring hearth and a single drive mechanism connected to the ring hearth for moving the ring hearth to transport the batches of metal workpieces in the heat treatment chamber during a heat treatment cycle.

7. The industrial furnace according to claim 2 wherein said entrance air lock comprises a vertical arrangement that includes a first air lock chamber, a second air lock chamber positioned above said first air lock chamber, an opening between said first and second air lock chambers, and a lift elevator operable for movement between the first and second air lock chambers through the opening, said lift elevator comprising a gas-tight closure device for sealing the second air lock chamber from the first air lock chamber when said lift elevator is in a fully raised position relative to said second lock chamber and when said lift elevator is in a fully lowered position relative to said second lock chamber, the first air lock chamber is sealable from the surrounding environment by the first gas-tight door, the second lock chamber is connected to the entrance end of said heat treating chamber, and the industrial furnace further comprises a gas-permeable door positioned between the second air lock chamber and the heat treatment chamber.

8. The industrial furnace according to claim 2 wherein said entrance air lock comprises a horizontal arrangement having a single lock chamber, the first gas-tight door is positioned at an entrance side of the lock chamber, and the industrial furnace comprises a second gas-tight door positioned between the lock chamber and said heat treatment chamber.

9. The industrial furnace according to claim 7 comprising gas supply connections disposed in a wall of the heat treatment chamber for admitting the protective gas to said exit lock and a second used-gas conveying line connected to said exit lock for conveying used protective gas from said exit lock.

10. The industrial furnace according to claim 9 wherein the protective gas extraction system is connected to said exit lock for removing protective gas from the exit lock and transferring the protective gas for use downstream of the industrial furnace or for reuse in the industrial furnace itself.

11. The industrial furnace according to claim 8 comprising a second protective gas supply line connected to the exit lock and a second used-gas conveying line connected to the exit lock for conveying used protective gas from the exit lock.

12. The industrial furnace according to claim 11 wherein the protective gas extraction system is connected to the exit lock for removing protective gas from the exit lock and transferring the protective gas for use downstream of the industrial furnace or for reuse in the industrial furnace itself.

13. The industrial furnace according to claim 2 comprising a quenching facility connected to said exit lock.

* * * * *